US005417088A

United States Patent [19]

Nakai

[11] Patent Number: 5,417,088

[45] Date of Patent: May 23, 1995

[54] KNIT FABRIC FOR A NECK PORTION OF A KNIT PRODUCT AND KNITTING METHOD THEREOF

[75] Inventor: Shun-ichi Nakai, Wakayama, Japan

[73] Assignee: Shima Seiki Mfg., Ltd., Wakayama, Japan

[21] Appl. No.: 806,742

[22] Filed: Dec. 13, 1991

[30] Foreign Application Priority Data

Dec. 13, 1990 [JP] Japan ..... 2-410349

[51] Int. Cl.[6] ..... D04B 7/10

[52] U.S. Cl. ..... 66/76; 66/172 R

[58] Field of Search ..... 66/66, 70, 69, 71, 64, 66/67, 171, 172 R, 189, 195, 200, 176, 73, 76, 77, 170, 175, 177, 198, 199

[56] References Cited

U.S. PATENT DOCUMENTS 2,899,812 8/1959 Attenborough ..... 66/176

3,640,097 2/1972 Bettes et al. ..... 66/176

FOREIGN PATENT DOCUMENTS 717807 1/1932 France .

2162999 7/1973 France .

2176447 10/1973 France .

0194154 10/1985 Japan ..... 66/176

2140469 11/1984 United Kingdom ..... 66/172 R 2183264 6/1987 United Kingdom ..... 66/176

*Primary Examiner*—Clifford D. Crowder

*Assistant Examiner*—Larry D. Worrell, Jr.

*Attorney, Agent, or Firm*—Edwin E. Greigg; Ronald E. Greigg

[57] ABSTRACT

A method and apparatus for knitting the neck portion of a sweater cardigan or vest by use of a flat knitting machine carrying at least a pair of front and rear needle beds which are arranged movably in a longitudinal direction. The neck portion is formed subsequent to knitting of the right and left sides of the body.

12 Claims, 17 Drawing Sheets

KNIT FABRIC FOR A NECK PORTION OF A KNIT PRODUCT AND KNITTING METHOD THEREOF

BACKGROUND OF THE INVENTION

This invention refers to a knit fabric for a neck portion of a knit product such as a sweater, cardigan, or vest, and a knitting method thereof.

Conventionally, in order to form a neck of a knit product such as a sweater, cardigan, or vest having a V-shaped neck, U-shaped neck, round neck or turtleneck, the neck portion of the knit fabric is cut into a V-shape, U-shape or round shape after the front body has been knitted, and after that, a reinforcement piece or a turtleneck is linked by using a knitting machine.

However, such a procedure requires a considerable length of time, thus decreasing the productivity.

Further, when the reinforcement piece or the turtleneck is sewed onto the front fabric, the overlapped portion would be thick, thus causing not only a bad appearance but less comfort in use.

In the light of the above problem, it is possible to knit the reinforcement piece or turtleneck subsequently to the cut-out neck portion, but in this case, the number of loops existing on the edge of the cut-out neck portion is so limited that the radius of the reinforcement piece or the turtleneck is formed too small to be actually used.

The present invention is intended to overcome the foregoing problems and its object is to provide a knitting method employed for a neck portion of a knit product in which a neck portion having a preferred radius or a preferred shape is knitted subsequently to the front body portion, and a knit fabric having a reinforcement piece or a turtleneck.

SUMMARY OF THE INVENTION

A knitting method of a knit fabric for a neck portion of a knit product in the present invention is characterized in that a front body is knitted by a flat knitting machine carrying at least a pair of front and rear needle beds either or both of which are arranged movably in the longitudinal direction, and that a cut-out portion for a neck is formed subsequently during the period in which both of the left and right. front body portions are knitted and a knit fabric for a neck portion is formed on the cut-out portion, while an action of widening stitches is done to loops for forming an edge of the cut-out portion or to loops for forming the front body portion.

Further, a knit fabric for a neck portion of a knit product is characterized in that it is knitted by a flat knitting machine carrying at least a pair of front and rear needle beds either or both of which are arranged movably in the longitudinal direction, and that at least one loop is divided into two loops so to increase the number of loops which form the neck portion.

DESCRIPTION OF THE PREFERRED EMBODIMENTS

Preferred embodiments of the present invention will be described referring to the accompanying drawings. Further, marks which appear in the drawings are explained as follows:

○ a missed front stitch
⊖ knitting of a front stitch
Ⓥ making of a front stitch tuck
⊗ a new loop
○ knitting of a back stitch ⊗ split knit
↑ transferring of a loop
↓ transferring of a loop
Ⓥ a missed front stitch tuck FIG. 1 illustrates a vest knitted in accordance with the invention;

FIG. 3 illustrates a portion of a knitting structure formed in FIGS. 2-1 to FIG. 2-30; FIGS. 4-1 to 4-29 illustrate a modification of the knit courses shown in FIGS. 2-1 to 2-30;

FIG. 5 illustrates a portion of a knitting structure formed in the courses shown in FIGS. 4-1 to 4-29;

FIG. 6 illustrates a vest with a V-neck; and

FIG. 7 illustrates a vest with a rounded neck.

A knitting method for a neck portion of a knit fabric according to the present invention is employed for a U-shaped neck portion 2 of a vest 1, and such method is executed by using a flat knitting machine which carries two, front and rear, movable needle beds provided in the inverted-V shape arrangement when viewed from one side, each bed carrying a multiplicity of knitting needles mounted on the top thereof for forward and backward movement.

Figure 1:
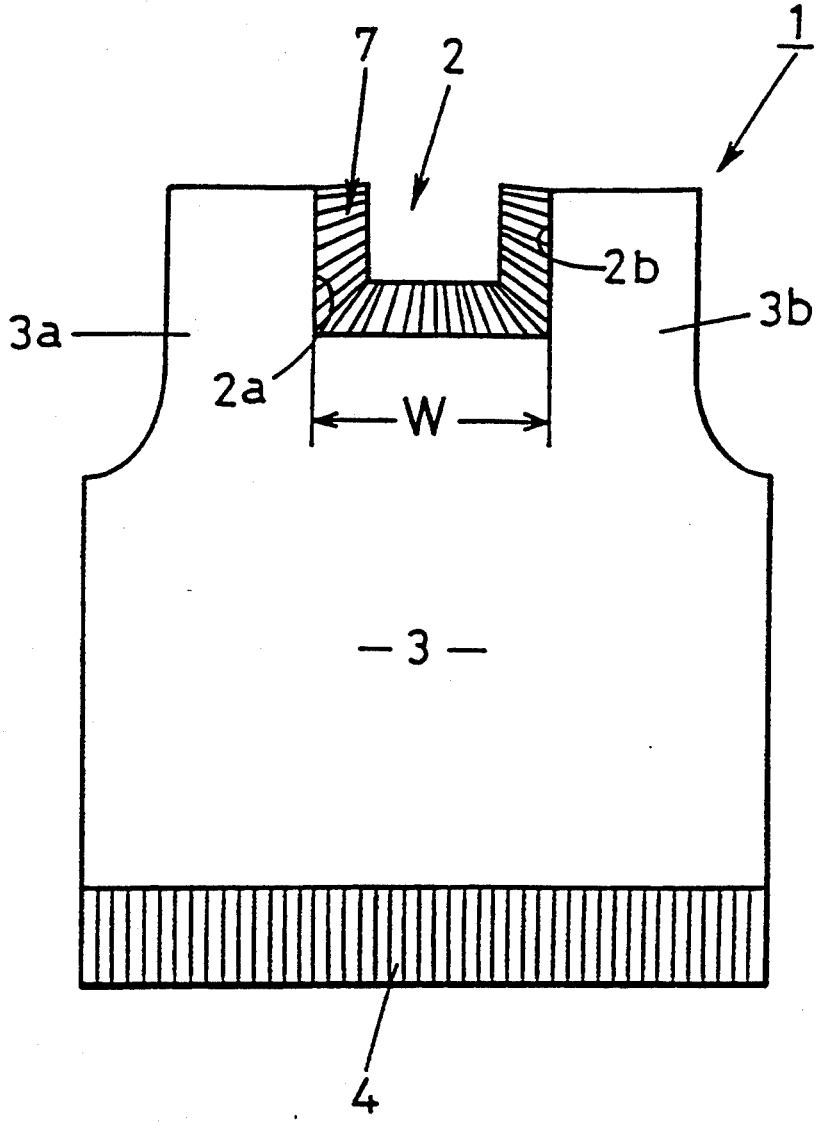
FIGS. 2-1 to 2-30 illustrate a series of primary courses for knitting the neck portion of the vest.

The knitting of a front body piece (knitted fabric) 3 of the vest 1 shown in FIG. 1 starts with its bottom region 4 and finishes with the neck portion 2.

FIGS. 2-1 to 2-30 illustrate a series of primary courses for knitting the neck portion 2, in which alphabetic capital letters A, B, C, D, . . . represent knitting needles of the front needle bed 5; alphabetic small case letters a, b, c, d, . . . are knitting needles of the rear needle bed 6, rightward numeral and letter P denote the distance of movement of the rear needle bed 6.

Wales which form a bottom part of U-shaped neck portion 2 are knitted by multiple knitting needles, but all those knitting needles are indicated as "W" in FIG. 1 for convenience in the following description.

The action at each of the courses for knitting the neck portion 2 will now be explained.

Figures 1, 2:
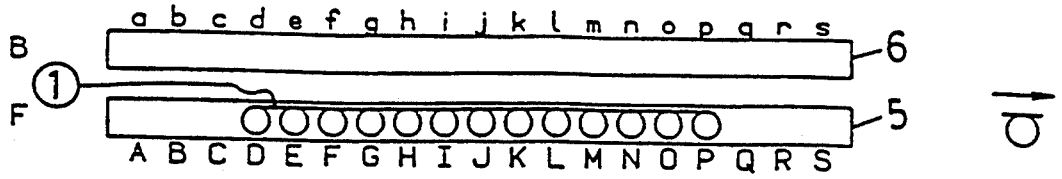
Figure 2:
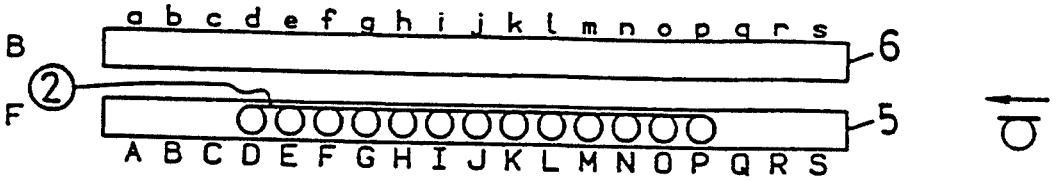

By repeating knitting courses of the front body as shown in FIG. 2-1 to 2-2, with yarns ①, ② supplied to the knitting needles D, E, F . . . N, O, P of the front needle bed 5, a front body 3 of the vest 1 is knitted.

Figures 2, 3:
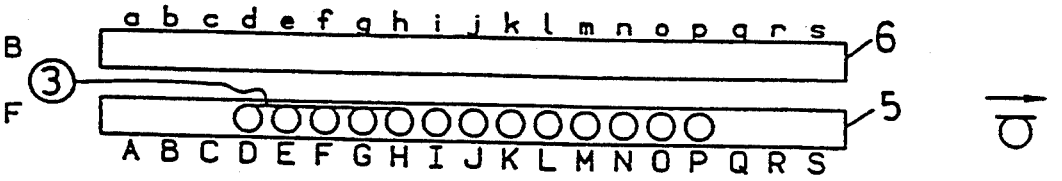

At the end of the front body 3 or the start of the neck portion 2, loops are formed on the knitting needles D to H, by which a front body part 3*a* on the left of the neck portion 2 is to be knitted by supplying a yarn ③ as shown in FIG. 2-3.

Figures 2, 3, 4:
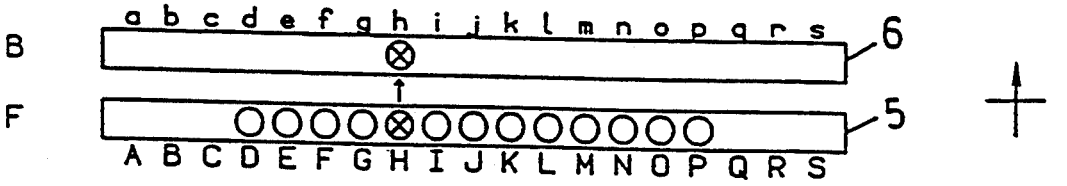

In FIG. 2-4, a loop held on the front knitting needle H is now also held on the rear knitting needle h and in FIG. 2-5, loops held on the front knitting needles D to G are transferred to the rear knitting needles d to g.

Accordingly, in FIG. 2-6, the rear needle bed 6 is moved 1 pitch leftward from the position shown in FIG. 2-5, and, loops held on the rear knitting needles d to h are transferred to the front knitting needles C to G. As a result, the loops held on the front needles D to H in FIG. 2-3 are now held on the front knitting needles C to H, thus there increases a loop which is to form the left-side edge 2*a* of the neck portion 2, in other words, the action of "widening stitches" is done.

In FIG. 2-7, a yarn ⑤ is supplied to the front knitting needles L to P and loops are formed on them, and on the other hand, a yarn ④ supplied to the front knitting needles is tucked on the knitting needle I and forms a loop on each of the front knitting needles C to G, while missing the knitting needle H.

A knitting structure formed through the courses in FIG. 2-4 to FIG. 2-7 appears to be as indicated with an arrow $\alpha$ in FIG. 3.

At the courses shown in FIGS. 2-8 to 2-11, the action from FIGS. 2-4 to 2-7 is done to widen stitches which are to form the right-side edge 2*a* of the neck portion 2. More specifically, in FIG. 2-8, a loop held on the front knitting needle L is now also held on the rear knitting needle 1. In FIG. 2-9, loops held on the front knitting needles M to P are transferred to the rear knitting needles m to p. In FIG. 2-10, the rear needle bed 6 is moved 1 pitch rightward from the position in FIG. 2-9, and then the loops on the rear knitting needles 1 to p are transferred to the front knitting needles M to Q. Thus, there increases a loop on the right-side edge 2*a* of the neck portion 2, in other words, the action of "widening stitches" is done.

In FIG. 2-11, a yarn (6) is supplied to the front knitting needles C to G and loops are: formed on them. On the other hand, a yarn (7) supplied to the front knitting needles is tucked on the knitting needle K at its left end and forms a loop on each of the front knitting needles M to Q, while missing the knitting needle L.

A knitting structure formed through the courses in FIGS. 2-8 to 2-11 appears to be as indicated with an arrow $\beta$ in FIG. 3.

Further, at the courses shown in FIGS. 2-12 to 2-15, the action from FIGS. 2-4 to 2-7 is done, and at the courses shown in FIGS. 2-16 to 2-19, the action of widening stitches as shown in the courses of FIGS. 2-8 to 2-11 is done to the right-side edge 2*b* of the neck portion 2.

Furthermore, at the courses shown in FIGS. 2-20 to 2-23 and the courses shown in FIGS. 2-24 to 2-27, the action of widening stitches is repeated on the left-side edge 2*a* and the right-side edge 2*b* of the neck portion 2, respectively.

Thus, the preferred number of loops are formed on the left-side edge 2*a* and the right-side edge 2*b* of the neck portion 2 of the vest 1.

Further a yarn (8) is supplied to the front knitting needles E to S in FIG. 2-28 and in FIG. 2-29, every other loop of the loops on the front knitting needles E to D is transferred to the every other rear knitting needles e, g, i, k, m, o. After that a yarn (9) is supplied to the knitting needles F, H. J, L, N and e, g, i, k, m, o as shown in FIG. 2-30 and rib-knitting is repeated for a predetermined number of times. As a result, a reinforcement portion 7 is formed subsequently to the left-side edge 2*a* and the right-side edge 2*b* of the neck portion 2.

Although not shown with figures, the courses shown in FIGS. 2-4 to 2-7 and the courses shown in FIGS. 2-8 to 2-11 may be changed as described in the following paragraphs.

After the loop held on the front knitting needle H in FIG. 2-4 is made to be held also on the rear knitting needle h, the rear needle bed 6 is moved 1 pitch rightward, and then the loops held on the front knitting needles D to H are transferred to the rear knitting needles c to g. Succeedingly, the rear needle bed 6 is moved 1 pitch leftward, and then the loops on the rear knitting needles c to h are transferred to the front knitting needles C to G.

Further, after the loop held on the front knitting needle L in FIG. 2-8 is made to be held also on the rear knitting needle 1, the rear needle bed 6 is moved 1 pitch leftward, and then the loops held on the front knitting needles L to P are transferred to the rear knitting needles m to p. Succeedingly, the rear needle bed 6 is moved 1 pitch rightward, and then the loops on the rear knitting needles 1 to q are transferred to the front knitting needles L to Q.

Additionally, in FIGS. 2-7, 2-11, 2-15, 2-19, 2-23 and 2-27, the knitting needle adjacent to the knitting needle holding the loop made by "widening stitches" is missed. In case the original loop and the loop made by "widening stitches" become entangled, the action of missing is not necessary.

In a second embodiment, a front body 3 of a vest 1 is knitted by repeating knitting courses as shown in FIGS. 4-1 and 4-2 as described in the first embodiment.

At the end of the front body 3 of the vest 1 or the start of the neck portion 2, as shown in FIG. 4-3, a yarn (3) is supplied to the front knitting needles D to H and new loops are formed, and at the same time, the old loop held on the knitting needle H is transferred to the rear knitting needle h by going through the newly formed loop and forms another loop, in other words, "split knit" (See Japanese Patent Publication Sho. 62-52063) is done here. In FIG. 4-4, the loops held on the front knitting needles D to G are transferred to the rear knitting needles d to g.

Although the action of forming a new loop by supplying the yarn (3) to the front knitting needle H and the action of transferring the old loop held on the front knitting needle H to the rear knitting needle h through the newly formed loop occur coincidentally in the above method, that is, "split knit" is done in the above method, the two actions may occur step by step.

Figures 2, 3, 4, 5:
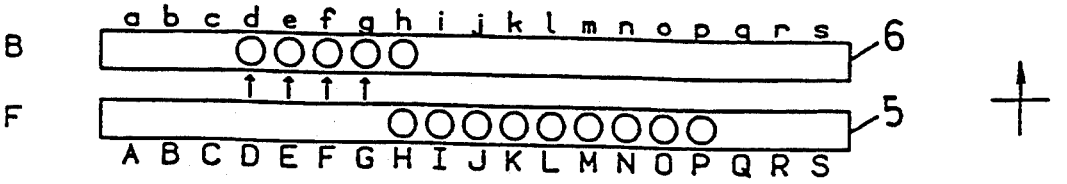

In FIG. 4-5, the rear needle bed 6 moves 1 pitch leftward from the position shown in FIG. 4-4, and loops held on the rear knitting needles d to h are transferred to the front knitting needles C to G.

Figures 2, 3, 4, 5, 6:
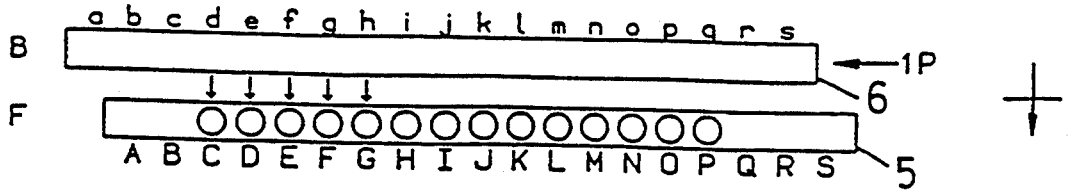

In FIG. 4-6, a yarn (4) tucked on the front knitting needle I is supplied to the front knitting needles C to H and loops are formed on them. Thus, the loops held on the front knitting needles D to H in FIG. 4-3 are now held on the front knitting needles C to H. By this way, a loop for forming the left-side edge 2*a* of the neck portion 2 is added, that is, the action of "widening stitches" is done.

A knitting structure formed in the knitting courses FIG. 4-3 to 4-6 appears to be as indicated with an arrow in FIG. 5.

At the courses shown in FIG. 4-7 to 4-10, almost the same action as the courses shown in FIG. 4-3 to 4-6 is done to increase the number of loops for forming the right-side edge 2*b* of the neck portion 2.

More specifically, in FIG. 4-7, a yarn (5) is supplied to the front knitting needle L after the loop originally held on the front knitting needle L is transferred to the rear knitting needle 1, that is, the action of "split knit" is done, and in FIG. 4-8, the loops held on the front knitting needles M to P are transferred to the rear knitting needles m to p.

In FIG. 4-9, the rear needle bed 6 is moved 1 pitch rightward from the position shown in FIG. 4-8, and loops held on the rear knitting needles l to p are transferred to the front knitting needles M to Q. As a result, the loops held on the front knitting needles L to P in FIG. 4-7 are now held on the front knitting needles M to Q, and the number of loops at the right-side edge 2*b* of the neck portion 2 increases, that is, "widening stitches" has been done.

In FIG. 4-10, a yarn ⑥ tucked on the front knitting needles K is supplied to the front knitting needles L to Q and loops are formed on them.

A knitting structure formed in the knitting courses of FIGS. 4-7 to 4-10 appears to be as shown with an arrow δ in FIG. 5.

Further, at the. courses in FIGS. 4-11 to 4-14, the courses shown in FIGS. 4-3 to FIG. 4-6 are repeated and at the courses in FIGS. 4-15 to 4-18, the action of "widening stitches" which is shown at the courses in FIGS. 4-7 to 4-10 is done. Accordingly, "widening stitches" is repeated at the left-side edge 2*a* and the right-side edge 2*b* of the neck portion 2 in FIGS. 4-19 to 4-22 and in FIGS. 2-23 to 2-26, and an expected number of loops can be formed at the left-side edge 2*a* and the right-side edge 2*b* of the neck portion 2.

Further, a yarn ⑦ is supplied to the front knitting needles E to S in FIG. 4-27, and in FIG. 4-28, every other loop of the loops on the front knitting needles E to D is transferred to the every other rear knitting needles e, g, i, k, m, o. After that, rib-knitting is repeated. by the front knitting needles F, H, J, L, N and the rear knitting needles e, g, i, k, m, o, as shown in FIG. 4-29, for the number of predetermined times. Then, a reinforcement portion 7 is formed successively to the left-side edge 2*a* and the right-side edge 2*b* of the neck portion 2.

In the above two embodiments, a flat knitting machine carrying a multiplicity of knitting needles on a pair of front and rear movable needle beds is employed, but it is needless to say that more than one pair of the needle beds might be arranged instead.

Further, although the rear needle bed is provided movably in the embodiments, it is needless to say that the front needle bed may, instead of the rear needle bed, be provided to be movably, or both the rear and front needle beds may be provided movably.

Furthermore, the left front body portion and the right front body portion in the embodiments is knitted separately by supplying a yarn to each of them. However, when either of said front body portions is knitted up to the shoulder portion first, and then, the other front body portion is knitted, both the front body portions are knitted to the shoulder portions by only one yarn.

Figures 2, 3, 4, 5, 6, 7:
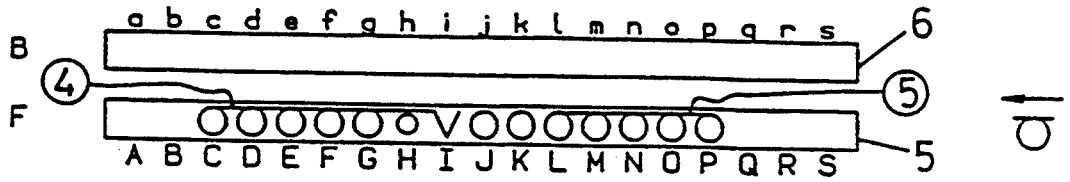
Figures 2, 3, 4, 5, 6, 7, 8:
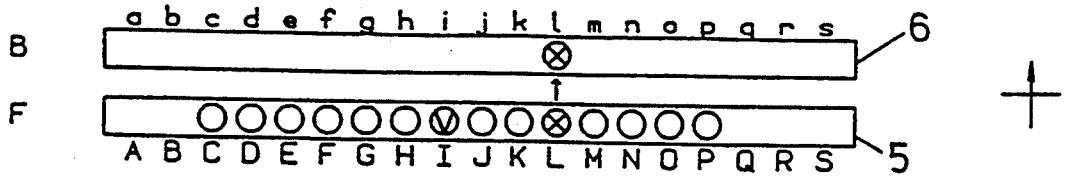
Figures 2, 3, 4, 5, 6, 7, 8, 9:
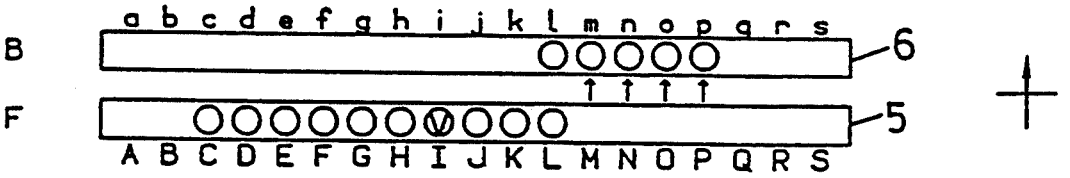
Figures 2, 3, 4, 5, 6, 7, 8, 9, 10:
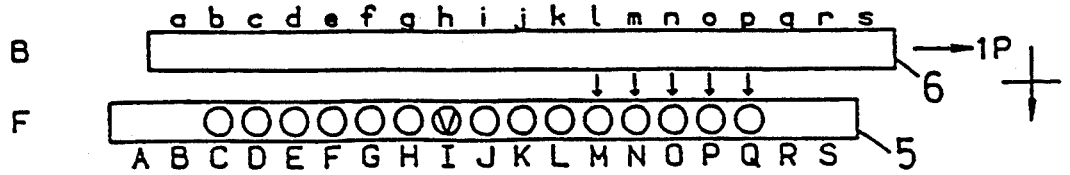
Figures 2, 3, 4, 5, 6, 7, 8, 9, 10, 11:
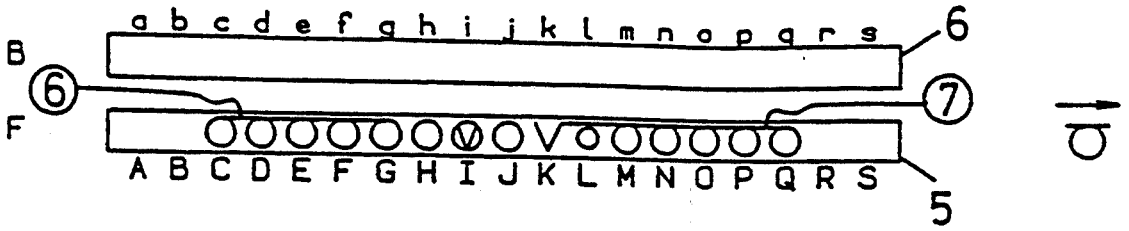
Figures 2, 3, 4, 5, 6, 7, 8, 9, 10, 11, 12:
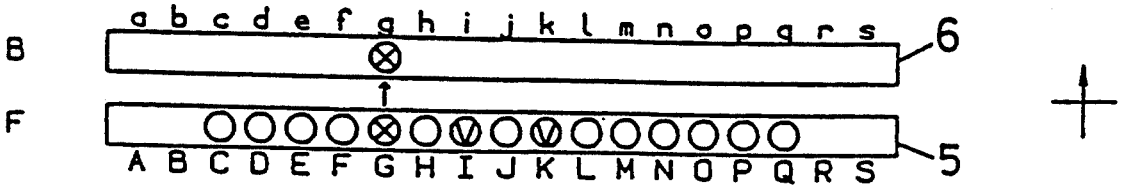
Figures 2, 3, 4, 5, 6, 7, 8, 9, 10, 11, 12, 13:
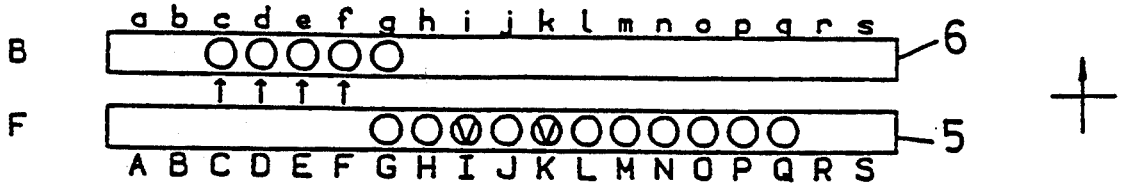
Figures 2, 3, 4, 5, 6, 7, 8, 9, 10, 11, 12, 13, 14:
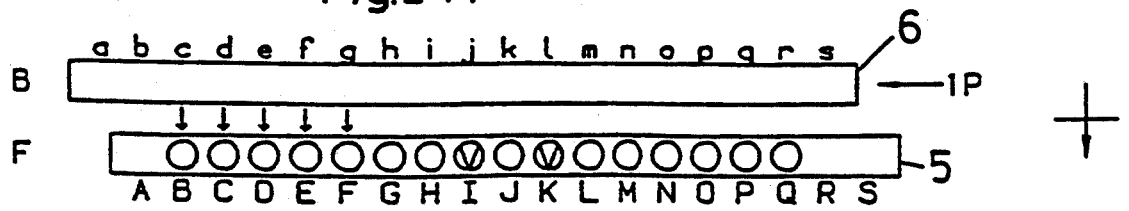
Figures 2, 3, 4, 5, 6, 7, 8, 9, 10, 11, 12, 13, 14, 15:
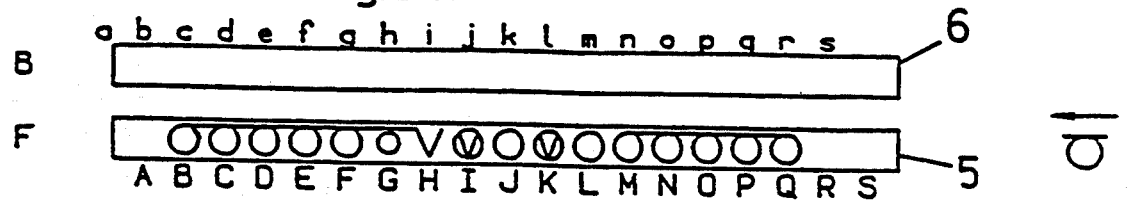
Figures 2, 3, 4, 5, 6, 7, 8, 9, 10, 11, 12, 13, 14, 15, 16:
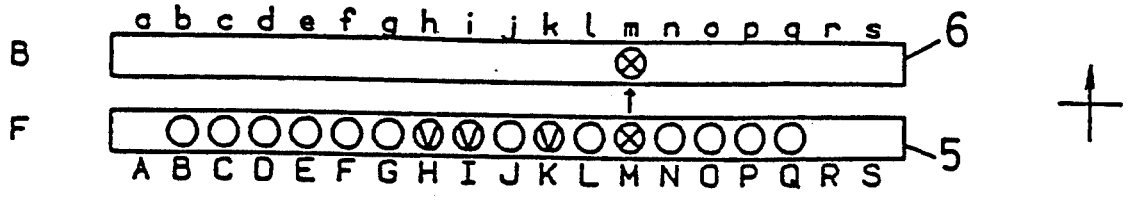
Figures 2, 3, 4, 5, 6, 7, 8, 9, 10, 11, 12, 13, 14, 15, 16, 17:
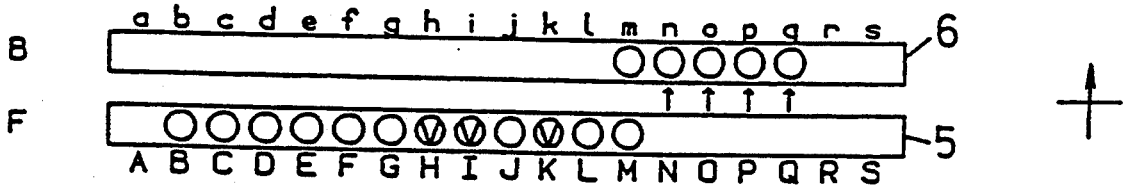
Figures 2, 3, 4, 5, 6, 7, 8, 9, 10, 11, 12, 13, 14, 15, 16, 17, 18:
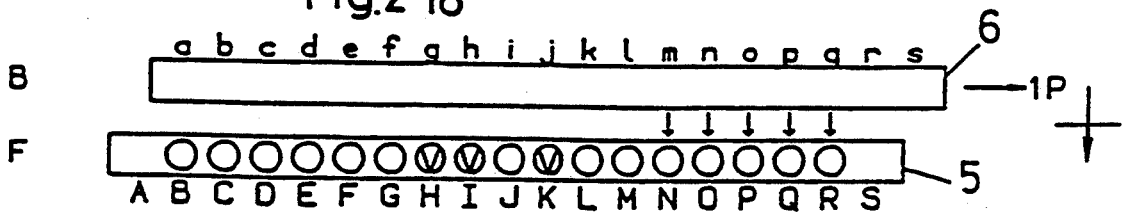
Figures 2, 3, 4, 5, 6, 7, 8, 9, 10, 11, 12, 13, 14, 15, 16, 17, 18, 19:
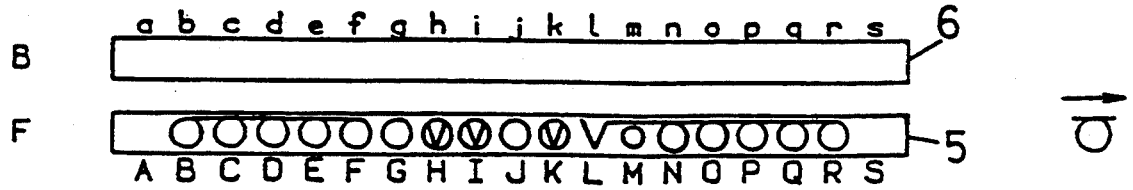
Figures 2, 3, 4, 5, 6, 7, 8, 9, 10, 11, 12, 13, 14, 15, 16, 17, 18, 19, 20:
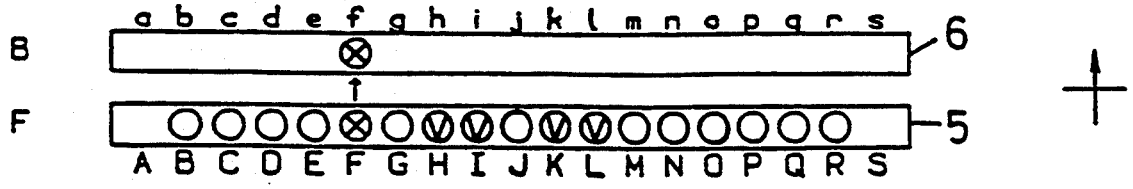
Figures 2, 3, 4, 5, 6, 7, 8, 9, 10, 11, 12, 13, 14, 15, 16, 17, 18, 19, 20, 21:
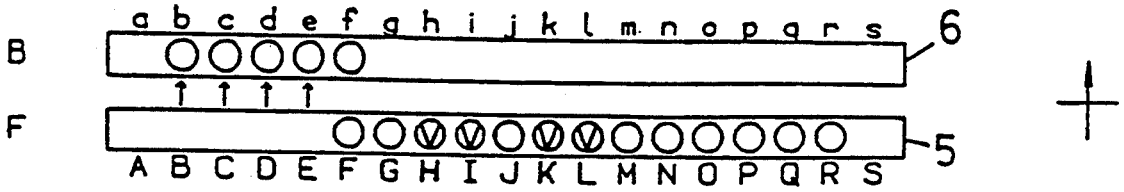
Figures 2, 3, 4, 5, 6, 7, 8, 9, 10, 11, 12, 13, 14, 15, 16, 17, 18, 19, 20, 21, 22:
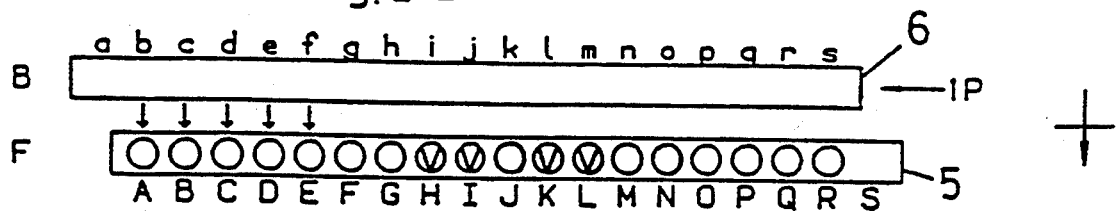
Figures 2, 3, 4, 5, 6, 7, 8, 9, 10, 11, 12, 13, 14, 15, 16, 17, 18, 19, 20, 21, 22, 23:
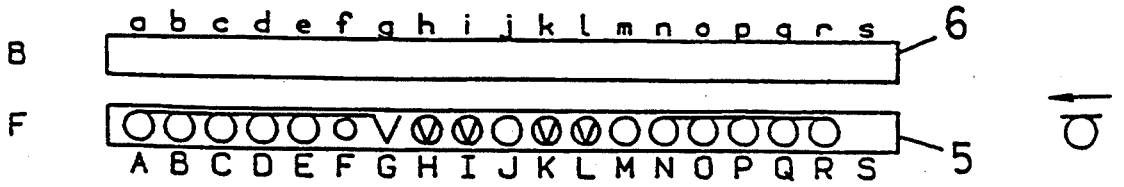
Figures 2, 3, 4, 5, 6, 7, 8, 9, 10, 11, 12, 13, 14, 15, 16, 17, 18, 19, 20, 21, 22, 23, 24:
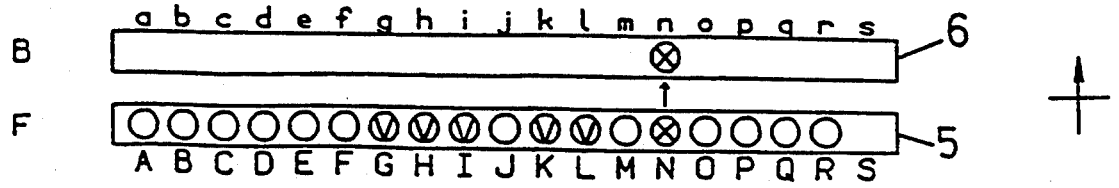
Figures 2, 3, 4, 5, 6, 7, 8, 9, 10, 11, 12, 13, 14, 15, 16, 17, 18, 19, 20, 21, 22, 23, 24, 25:
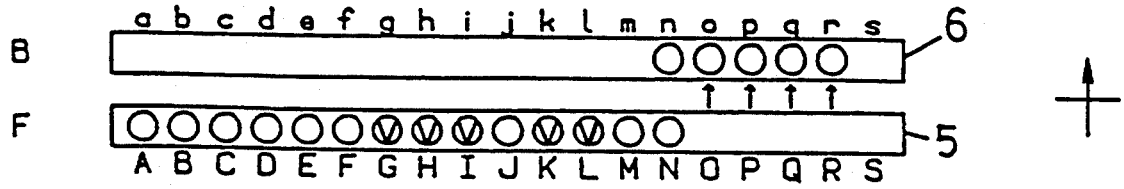
Figures 2, 3, 4, 5, 6, 7, 8, 9, 10, 11, 12, 13, 14, 15, 16, 17, 18, 19, 20, 21, 22, 23, 24, 25, 26:
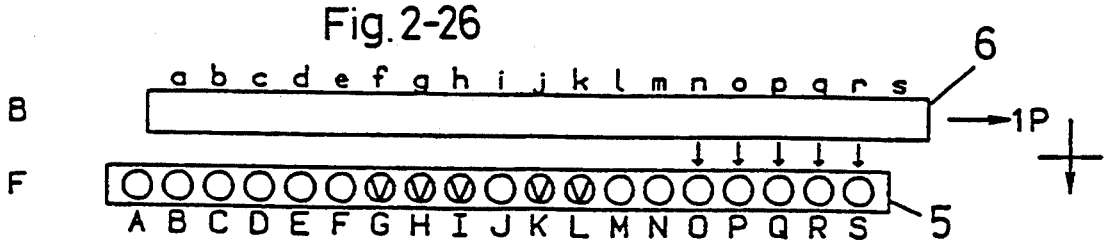
Figures 2, 3, 4, 5, 6, 7, 8, 9, 10, 11, 12, 13, 14, 15, 16, 17, 18, 19, 20, 21, 22, 23, 24, 25, 26, 27:
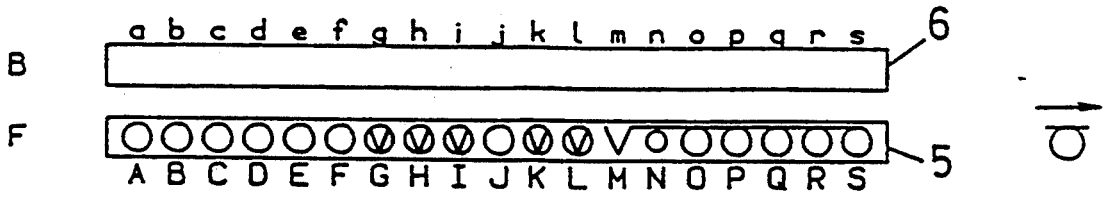
Figures 2, 3, 4, 5, 6, 7, 8, 9, 10, 11, 12, 13, 14, 15, 16, 17, 18, 19, 20, 21, 22, 23, 24, 25, 26, 27, 28:
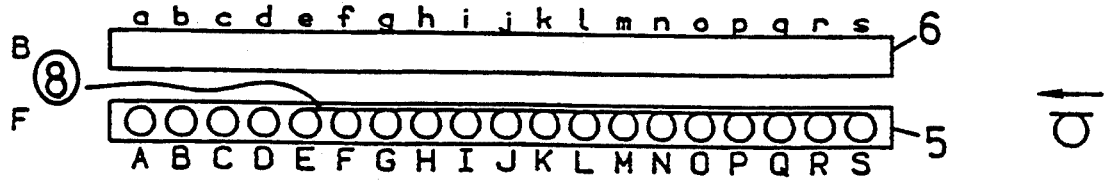
Figures 2, 3, 4, 5, 6, 7, 8, 9, 10, 11, 12, 13, 14, 15, 16, 17, 18, 19, 20, 21, 22, 23, 24, 25, 26, 27, 28, 29:
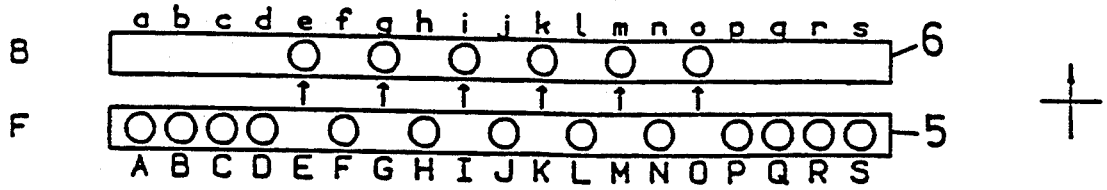
Figures 2, 3, 4, 5, 6, 7, 8, 9, 10, 11, 12, 13, 14, 15, 16, 17, 18, 19, 20, 21, 22, 23, 24, 25, 26, 27, 28, 29, 30:
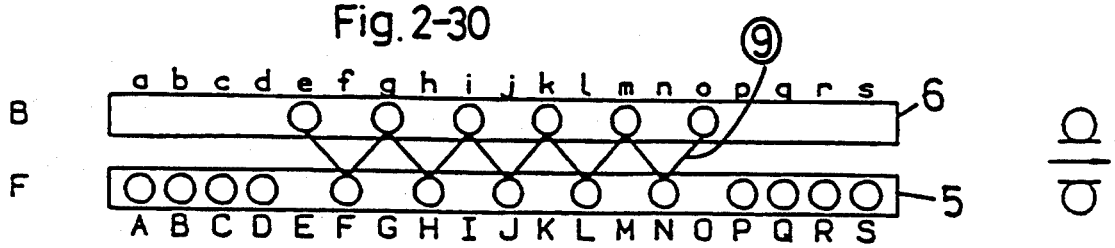
Figure 3:
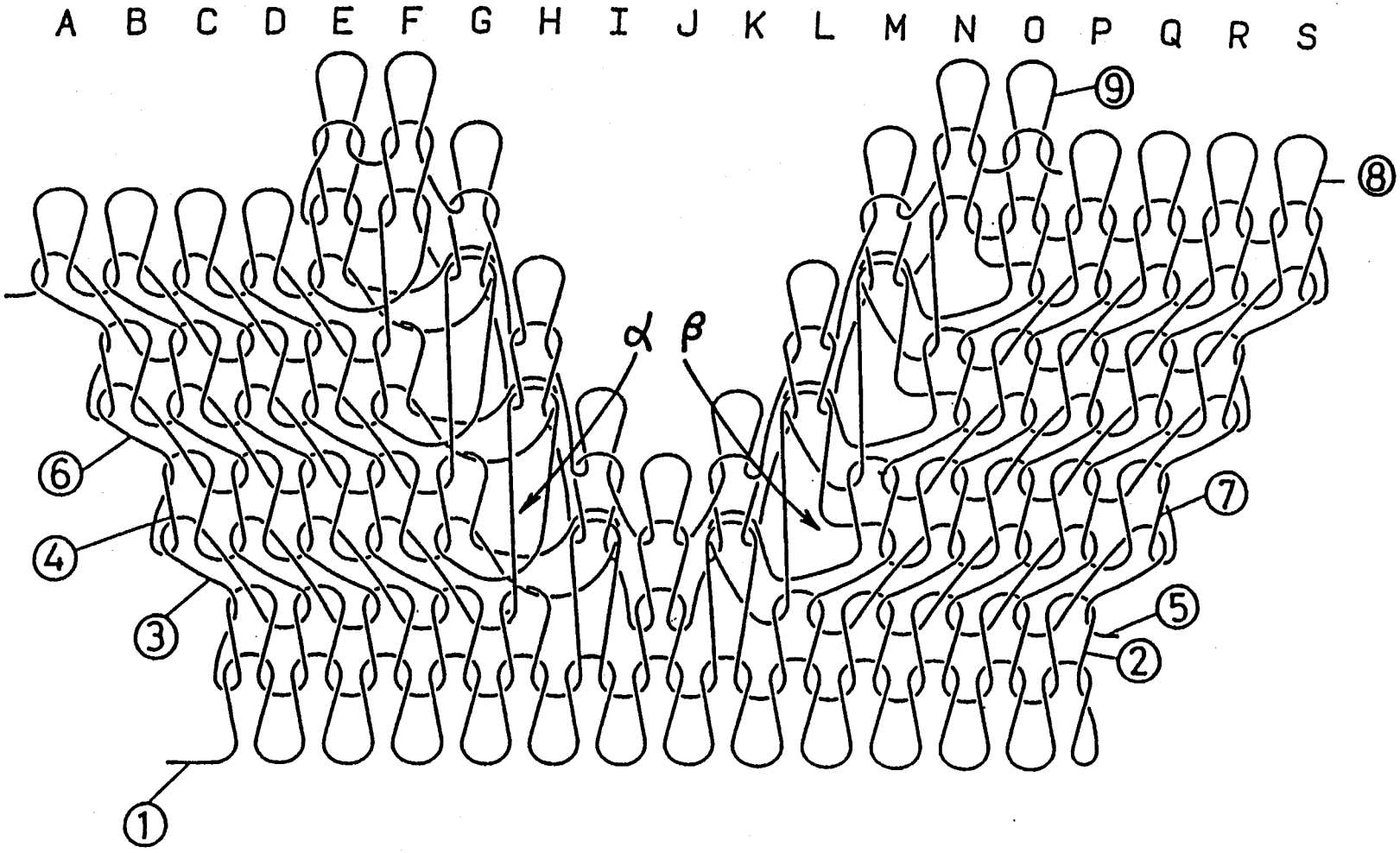
Figures 1, 4:
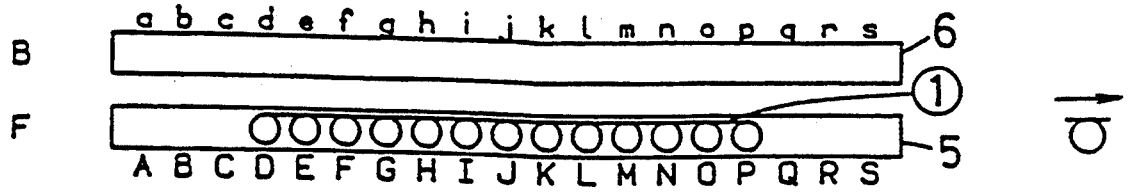
Figures 2, 4:
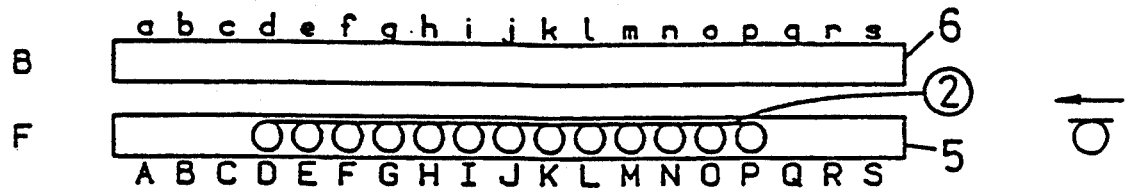
Figures 3, 4:
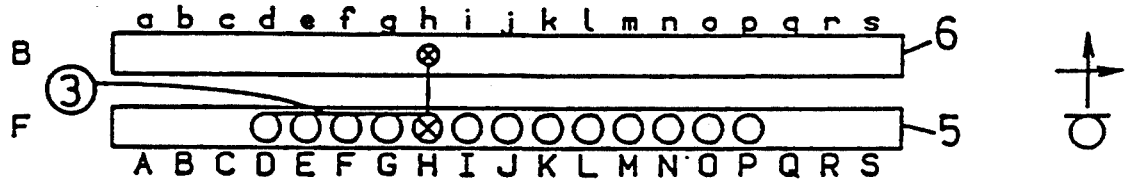
Figure 4:
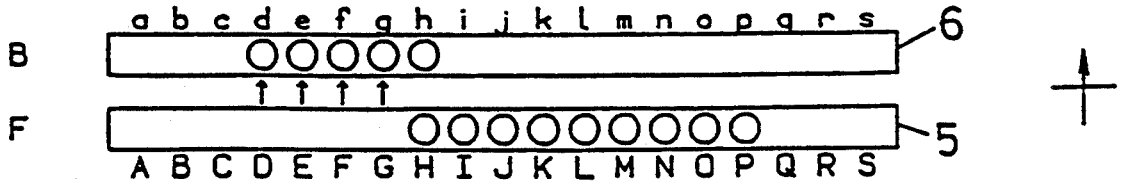
Figures 4, 5:
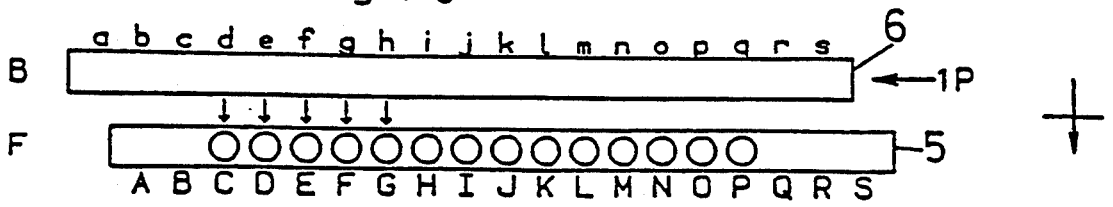
Figures 4, 5, 6:
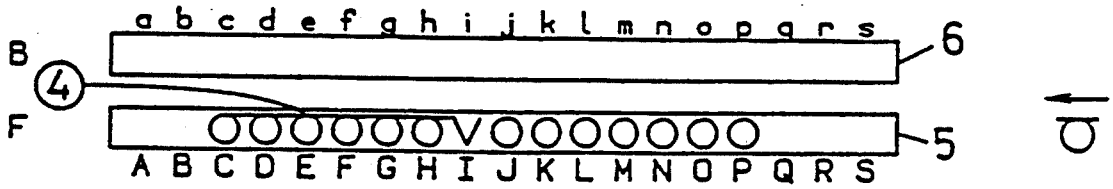
Figures 4, 5, 6, 7:
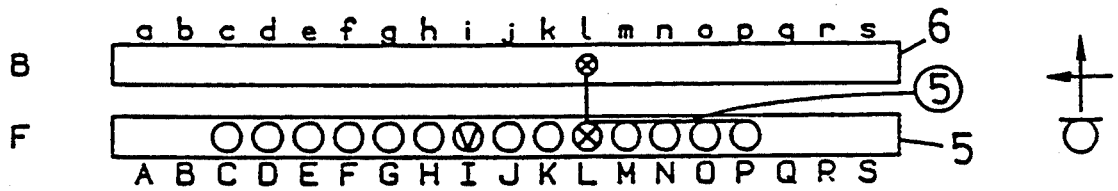
Figures 4, 5, 6, 7, 8:
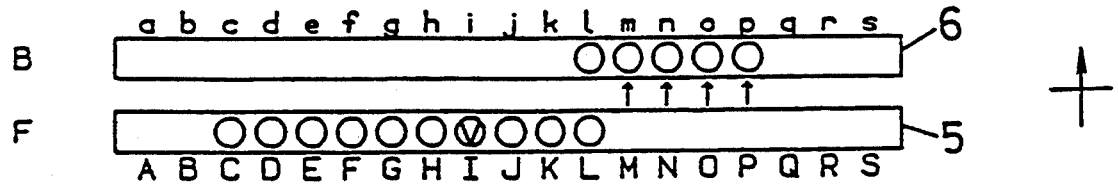
Figures 4, 5, 6, 7, 8, 9:
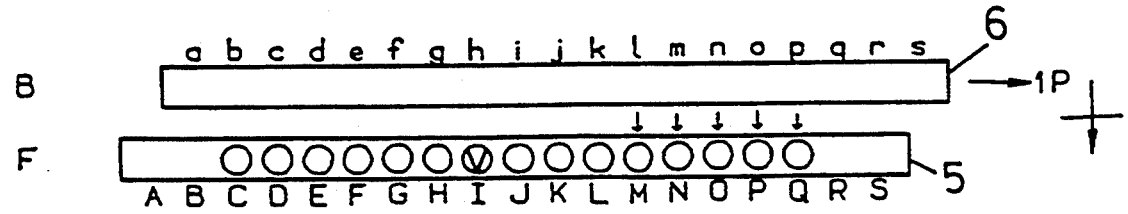
Figures 4, 5, 6, 7, 8, 9, 10:
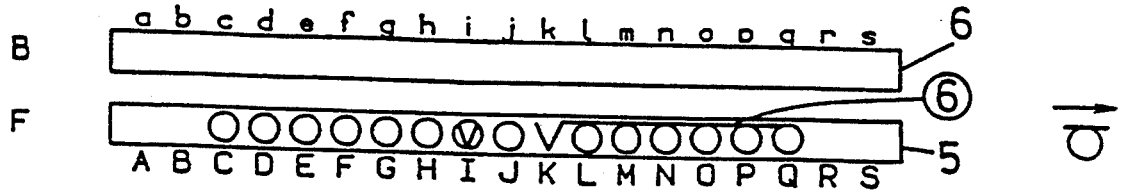
Figures 4, 5, 6, 7, 8, 9, 10, 11:
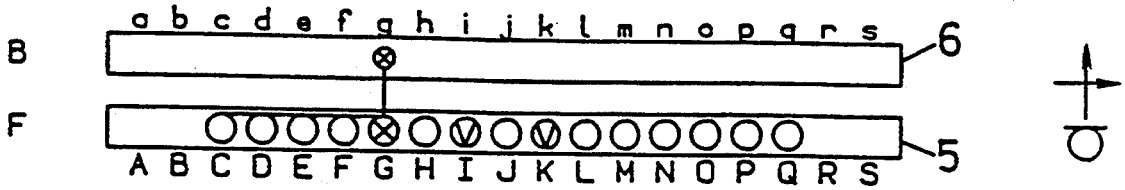
Figures 4, 5, 6, 7, 8, 9, 10, 11, 12:
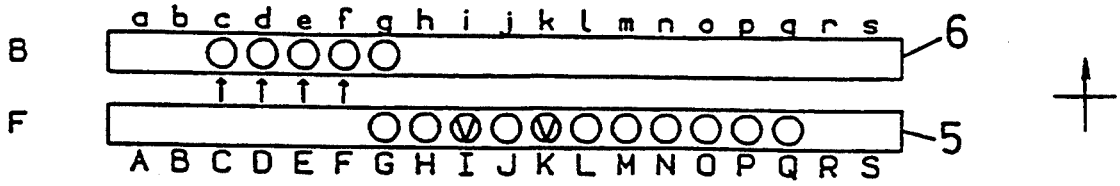
Figures 4, 5, 6, 7, 8, 9, 10, 11, 12, 13:
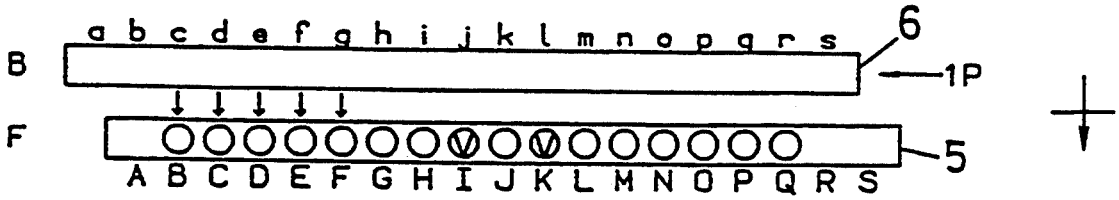
Figures 4, 5, 6, 7, 8, 9, 10, 11, 12, 13, 14:
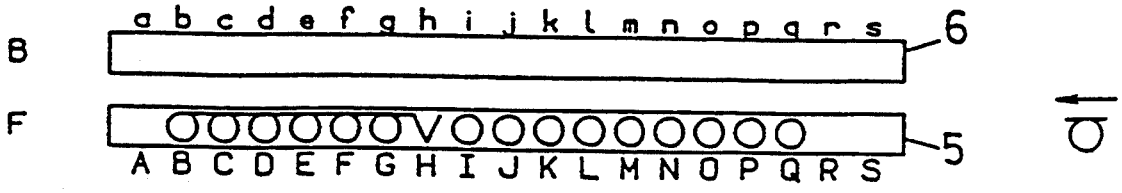
Figures 4, 5, 6, 7, 8, 9, 10, 11, 12, 13, 14, 15:
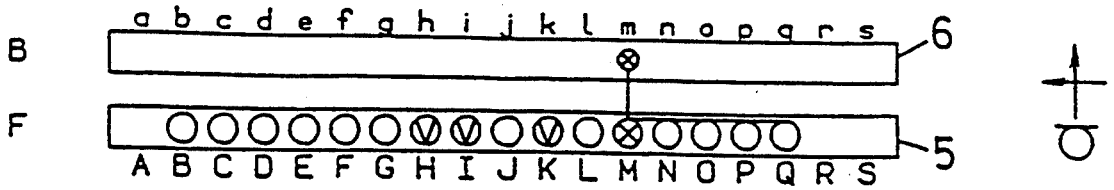
Figures 4, 5, 6, 7, 8, 9, 10, 11, 12, 13, 14, 15, 16:
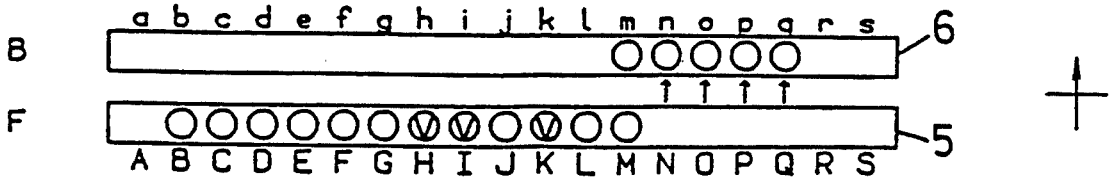
Figures 4, 5, 6, 7, 8, 9, 10, 11, 12, 13, 14, 15, 16, 17:
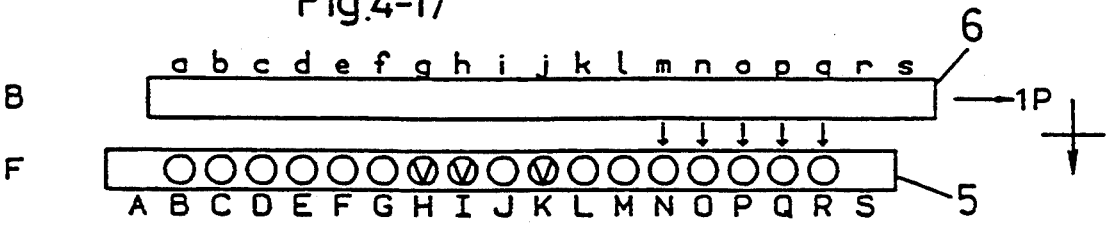
Figures 4, 5, 6, 7, 8, 9, 10, 11, 12, 13, 14, 15, 16, 17, 18:
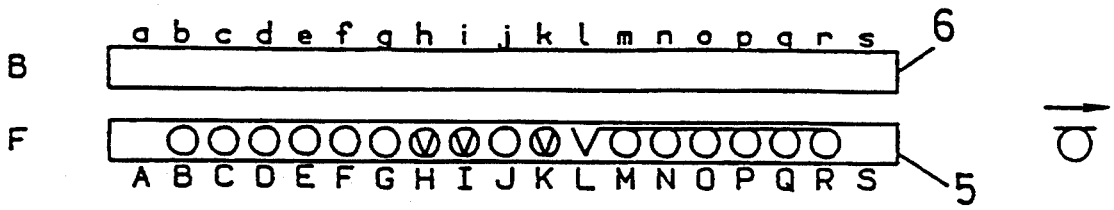
Figures 4, 5, 6, 7, 8, 9, 10, 11, 12, 13, 14, 15, 16, 17, 18, 19:
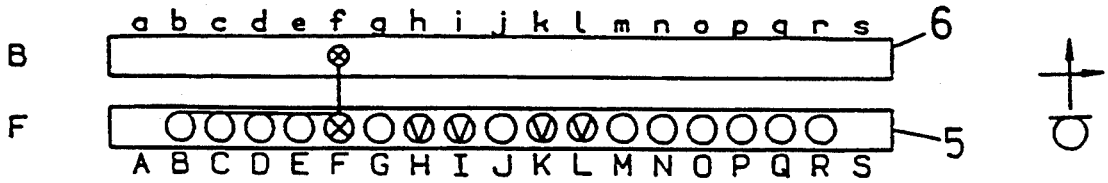
Figures 4, 5, 6, 7, 8, 9, 10, 11, 12, 13, 14, 15, 16, 17, 18, 19, 20:
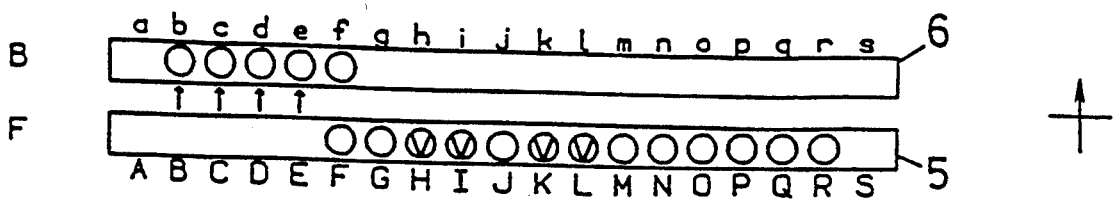
Figures 4, 5, 6, 7, 8, 9, 10, 11, 12, 13, 14, 15, 16, 17, 18, 19, 20, 21:
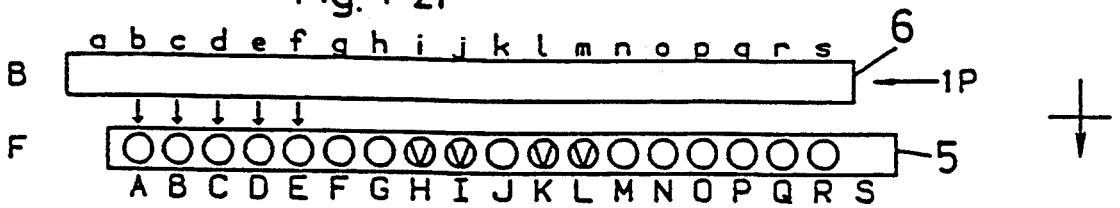
Figures 4, 5, 6, 7, 8, 9, 10, 11, 12, 13, 14, 15, 16, 17, 18, 19, 20, 21, 22:
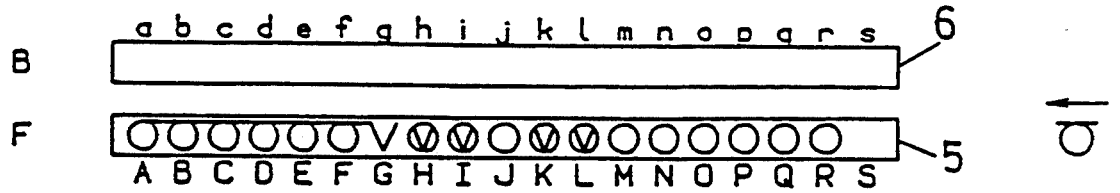
Figures 4, 5, 6, 7, 8, 9, 10, 11, 12, 13, 14, 15, 16, 17, 18, 19, 20, 21, 22, 23:
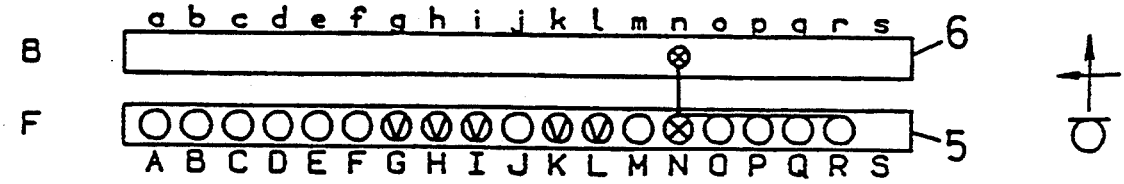
Figures 4, 5, 6, 7, 8, 9, 10, 11, 12, 13, 14, 15, 16, 17, 18, 19, 20, 21, 22, 23, 24:
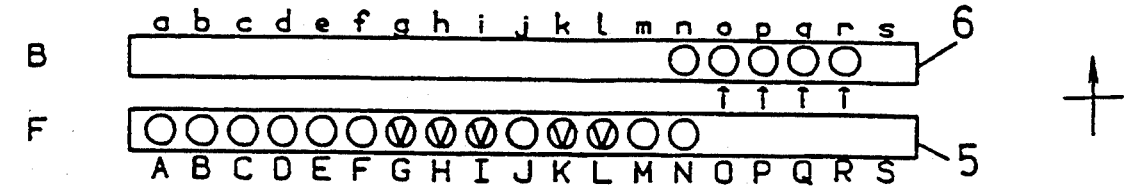
Figures 4, 5, 6, 7, 8, 9, 10, 11, 12, 13, 14, 15, 16, 17, 18, 19, 20, 21, 22, 23, 24, 25:
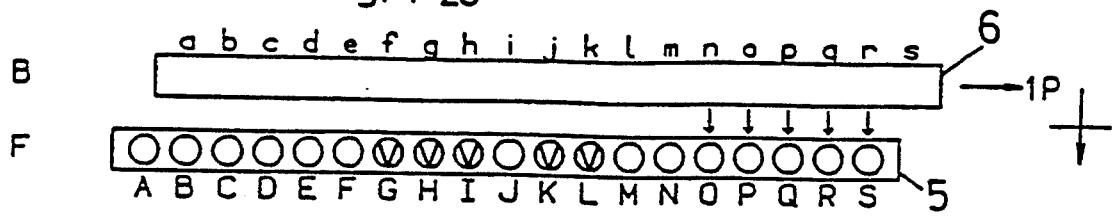
Figures 4, 5, 6, 7, 8, 9, 10, 11, 12, 13, 14, 15, 16, 17, 18, 19, 20, 21, 22, 23, 24, 25, 26:
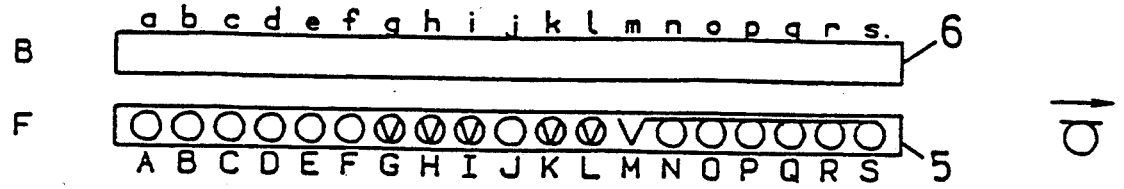
Figures 4, 5, 6, 7, 8, 9, 10, 11, 12, 13, 14, 15, 16, 17, 18, 19, 20, 21, 22, 23, 24, 25, 26, 27:
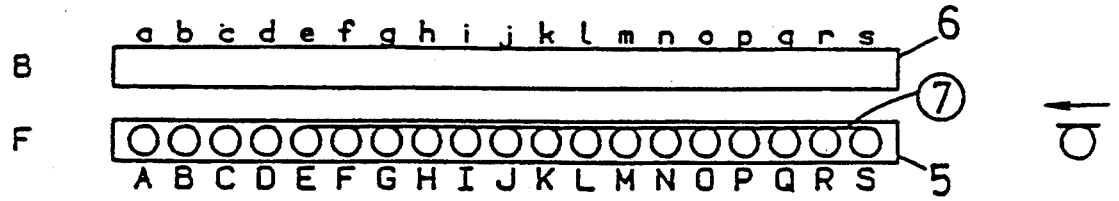
Figures 4, 5, 6, 7, 8, 9, 10, 11, 12, 13, 14, 15, 16, 17, 18, 19, 20, 21, 22, 23, 24, 25, 26, 27, 28:
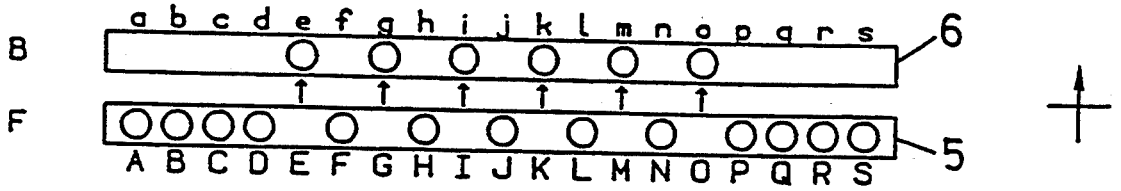
Figures 4, 5, 6, 7, 8, 9, 10, 11, 12, 13, 14, 15, 16, 17, 18, 19, 20, 21, 22, 23, 24, 25, 26, 27, 28, 29:
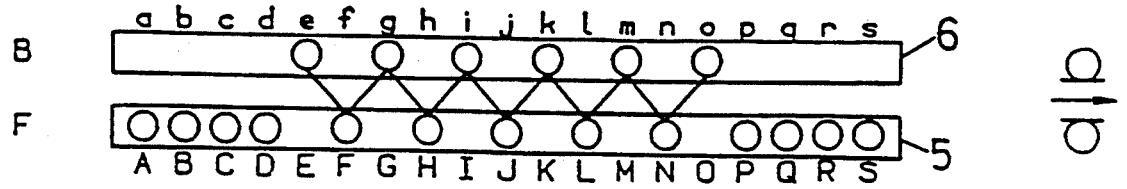
Figure 5:
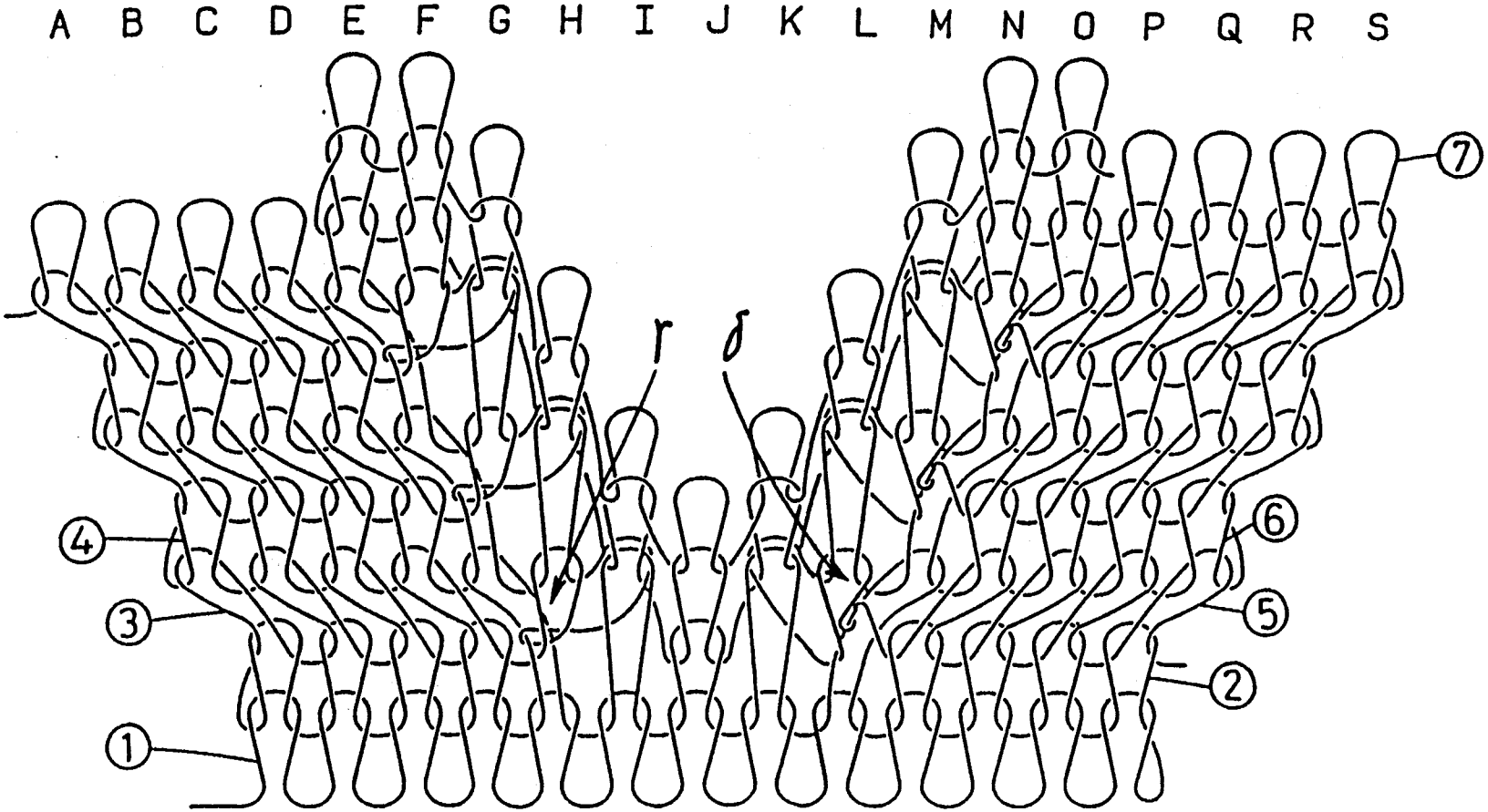
Figure 6:
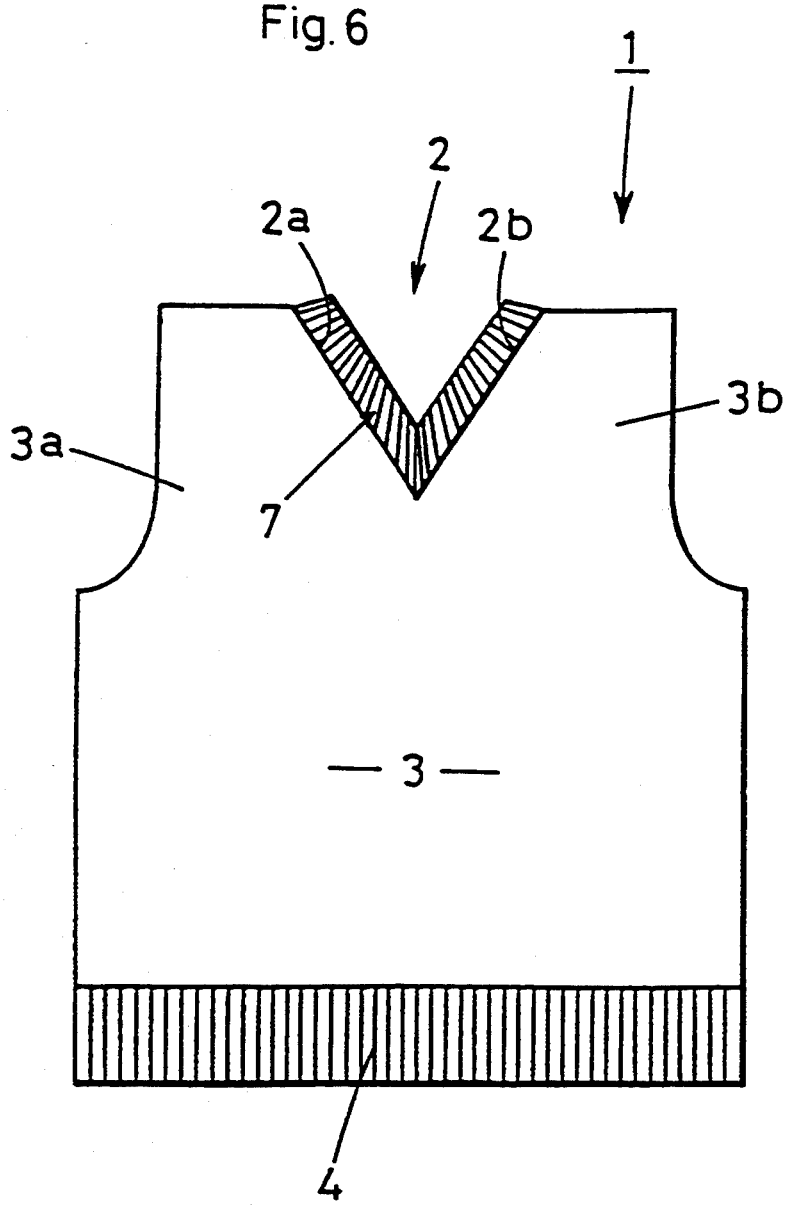
Figure 7:
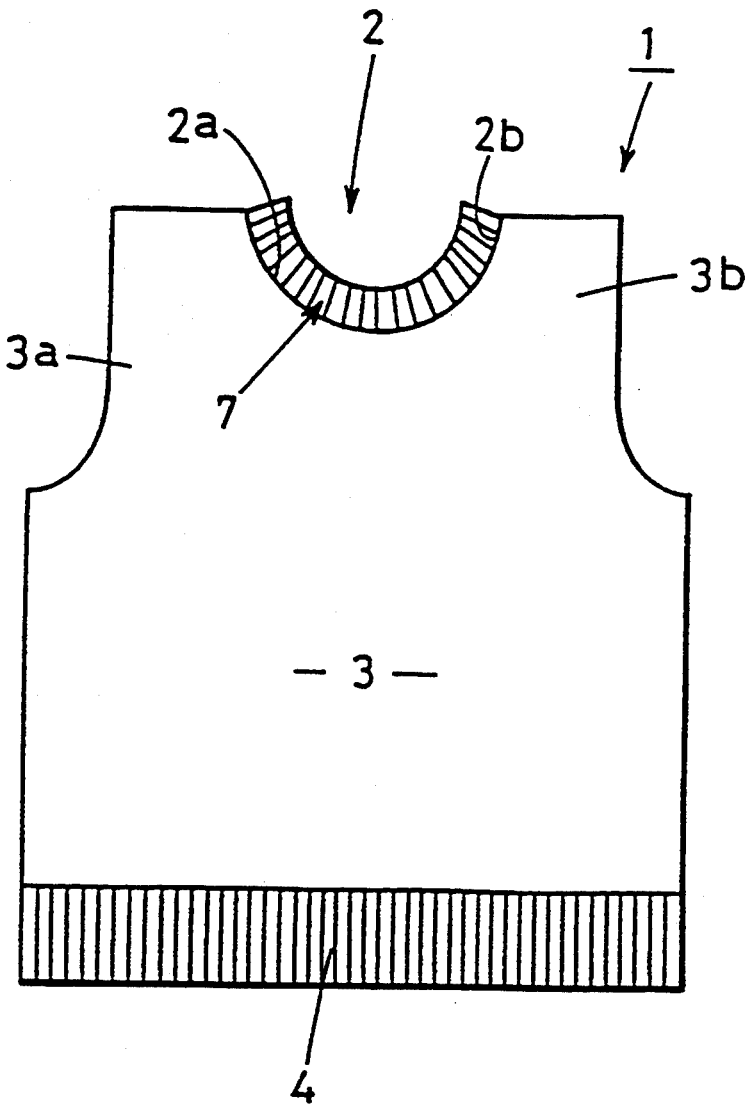

Additionally, although a U-shaped neck portion is obtained by the method in the embodiments, when a width of reciprocating motion in the knitting courses for forming the left-side edge and the right-side edge of the neck portion. is lessened at a predetermined rate as the left-side edge and the right-side edge of the neck portion are knitted up to the shoulder portion, a V-shaped neck as shown in FIG. 6 can be obtained. And, when the width of reciprocating motion is lessened at a large rate around the center of the cut-out neck portion, a round neck as shown in FIG. 7 can be obtained.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A method of knitting a product having a neck portion and a body portion with shoulder portions, comprising:

providing a flat bed knitting machine having one front needle bed and one rear needle bed, at least one of said front and rear needle beds being arranged movably in a longitudinal direction of said needle beds, knitting a front body portion, forming a cut-out course in the front body portion for subsequent knitting of a neck portion thereto, widening stitches of the cut-out course to form an edge of the neck portion thereby increasing the number of stitches at said edge, simultaneously knitting left and right shoulder portions and said neck portion about said cut-out portion wherein widening stitches is done to form said edge and said front body portion;

said widening stitches comprising:

transferring loops placed in an outside position of an increased loop held on the front needle bed to the rear needle bed;

moving at least one of the needle beds in a longitudinal direction of the needle beds; and transferring the loops on the rear needle bed to the front needle bed.

2. A knitting method for a cut-out neck portion of a knit product of claim 1, wherein a procedure to widen stitches for forming the front body portions and the edges of the neck portion comprises the steps of:

hooking a loop held on a front knitting needle of the front needle bed and also by a knitting needle of the rear needle bed;

transferring loops placed in an outside position of the affected loop held on the front knitting needles to the rear knitting needles;

moving at least one of the needle beds in the longitudinal direction of the needle beds so that the loops on the rear needle bed are not overlapped with the affected loop when the loops on the rear needle bed are transferred back to the front needle bed, transferring the loops on the rear needle bed to the front needle bed; and by repeating said procedure of widening stitches for a preferred number of times, the neck portion with added loops is formed.

3. A knitting method for a neck portion of a knit product of claim 1, wherein a procedure to widen stitches for forming the front body portions and the edges of the neck portion comprises the steps of:

forming a new loop with a supplied yarn on a front knitting needle which holds an old loop and transferring the old loop on the front knitting needle to a rear knitting needle;

moving both of the needle beds in the longitudinal direction of the needle beds so that the added loop should not be overlapped with the affected loop and loops placed in an outside position of the affected loop when the affected loop and the loops placed in the outside position of the affected loop are transferred from the front knitting needles to the rear knitting needles;

transferring the affected loop and the loops placed in the outside position of the affected loop from the front needle bed to the rear needle bed;

moving at least one of the needle beds in the longitudinal direction so that the loops held on the rear knitting needles do not overlap with loops which are originally placed on the front knitting needles when the loops held on the rear knitting needles are transferred to the front knitting needles;

transferring the loops held on the rear knitting needles to the front knitting needles; and repeating said procedure of widening stitches for a preferred number of times thereby forming a neck portion with the added loops.

4. A knitting method for a cut-out neck portion of a knit product of claim 1, wherein a predetermined number of loops placed at a center part of the cut-out portion of the neck portion are held on knitting needles while loops for forming a left-edge and a right-edge of the cut-out portion increase in the knitting courses one by one, whereby wales of a U-shaped cut-out portion of the neck portion is formed.

5. A knitting method for a cut-out neck portion of a knit product of claim 2, wherein a predetermined number of loops placed at a center part of the cut-out portion of the neck portion are held on knitting needles while loops for forming a left-edge and a right-edge of the cut-out portion increase in the knitting courses one by one, whereby wales of a U-shaped cut-out portion of the neck portion is formed.

6. A knitting method for a cut-out neck portion of a knit product of claim 3, wherein a predetermined number of loops placed at the center part of the cut-out portion of a neck are held on knitting needles while loops for forming a left-edge and a right-edge of the cut-out portion increase in the knitting courses one by one, thereby wales of a U-shaped cut-out portion of a neck is formed.

7. A knitting method for a cut-out neck portion of a knit product of claim 1, wherein a width of a reciprocating motion of the knitting courses for forming the left-edge and the right-edge of the cut-out portion of the neck is lessened at a predetermined rate as the left and the right front body portions are knitted upwardly, thereby wales of a V-shaped cut-out portion of a neck is formed.

8. A knitting method for a cut-out neck portion of a knit product of claim 2, wherein a width of reciprocating motion of the knitting courses for forming the left-edge and the right-edge of the cut-out portion of the neck is lessened at a predetermined rate as the left and the right front body portions are knitted upwardly, thereby wales of a V-shaped cut-out portion of a neck is formed.

9. A knitting method for a cut-out neck portion of a knit product of claim 3, wherein a width of reciprocating motion of the knitting courses for forming the left-edge and the right-edge of the cut-out portion of the neck is lessened at a predetermined rate as the left and the right front body portions are knitted upwardly, thereby wales of a V-shaped cut-out portion of a neck is formed.

10. A knitting method for a cut-out neck portion of a knit product of claim 1, wherein a width of reciprocating motion of the knitting courses for forming the left-edge and the right-edge of the cut-out portion of the neck is lessened as the left and the right front body portions are knitted upwardly and the width of reciprocating motion is lessened at a larger rate around the center part of the cut-out portion than a rate at the other part of the cut-out portion.

11. A knitting method for a cut-out neck portion of a knit product of claim 2, wherein a width of the knitting courses in the longitudinal direction of the needle beds for forming the left-edge and the right-edge of the cut-out portion of the neck portion is lessened as the left and the right front body portions are knitted upwardly and the width of knitting courses the longitudinal direction of the needle beds is lessened at a larger rate around a center part of the cut-out portion than a rate at the other part of the cut-out portion.

12. A knitting method for a cut-out neck portion of a knit product of claim 3, wherein a width of the knitting courses in the longitudinal direction of the needle beds for forming the left-edge and the right-edge of the cut-out portion of the neck portion is lessened as the left and the right front body portions are knitted upwardly and the width of the courses in the longitudinal direction of the needle beds is lessened at a larger rate around a center part of the cut-out portion than a rate at the other part of the cut-out portion.

* * * * *